US005114019A

United States Patent [19]

Sandbank

[11] Patent Number: 5,114,019

[45] Date of Patent: May 19, 1992

[54] NET FOR DISHWASHER RACK

[76] Inventor: Mary E. Sandbank, 902 W. Kemp Rd., Greensboro, N.C. 27410

[21] Appl. No.: 747,680

[22] Filed: Aug. 20, 1991

[51] Int. Cl.[5] ..... A47F 5/00

[52] U.S. Cl. ..... 211/41; 248/499

[58] Field of Search ..... 211/41, 183, 74; 248/499; 134/137, 135, 156

[56] References Cited

U.S. PATENT DOCUMENTS

| | | | |
|---|---|---|---|
| 4,664,266 | 5/1987 | Fausett et al. | 211/88 X |
| 4,770,381 | 9/1988 | Gold | 248/499 X |
| 4,832,206 | 5/1989 | Cunningham | 211/89 X |
| 4,974,806 | 12/1990 | Matern | 211/13 X |

*Primary Examiner*—Robert W. Gibson, Jr.
*Attorney, Agent, or Firm*—Rhodes, Coats & Bennett

[57] ABSTRACT

A removable retaining net for a dishwasher rack. The net includes a circular shaped center portion formed of substantially inelastic water resistant mesh; a bidirectionally elastic, open loop annular band connected along the periphery of the center portion; and an elastic edge band connected along the periphery of the annular band. The edge of the annular band adjacent to the center portion is substantially equal to the length of the periphery of the center portion and the edge of the annular band opposite the edge of the annular band adjacent to the center portion is substantially less than the length of the periphery of the center portion. This construction provides tension along periphery of the net when in use. Preferably the annular band is crocheted from 340 denier elastic yarn. Also, in the preferred embodiment the center portion is about 19 inches in diameter, after hemming, and is formed from polyester fabric having a mesh size of about ¼ inches in diameter. The periphery of the center portion can be hemmed to provide increased strength.

19 Claims, 2 Drawing Sheets

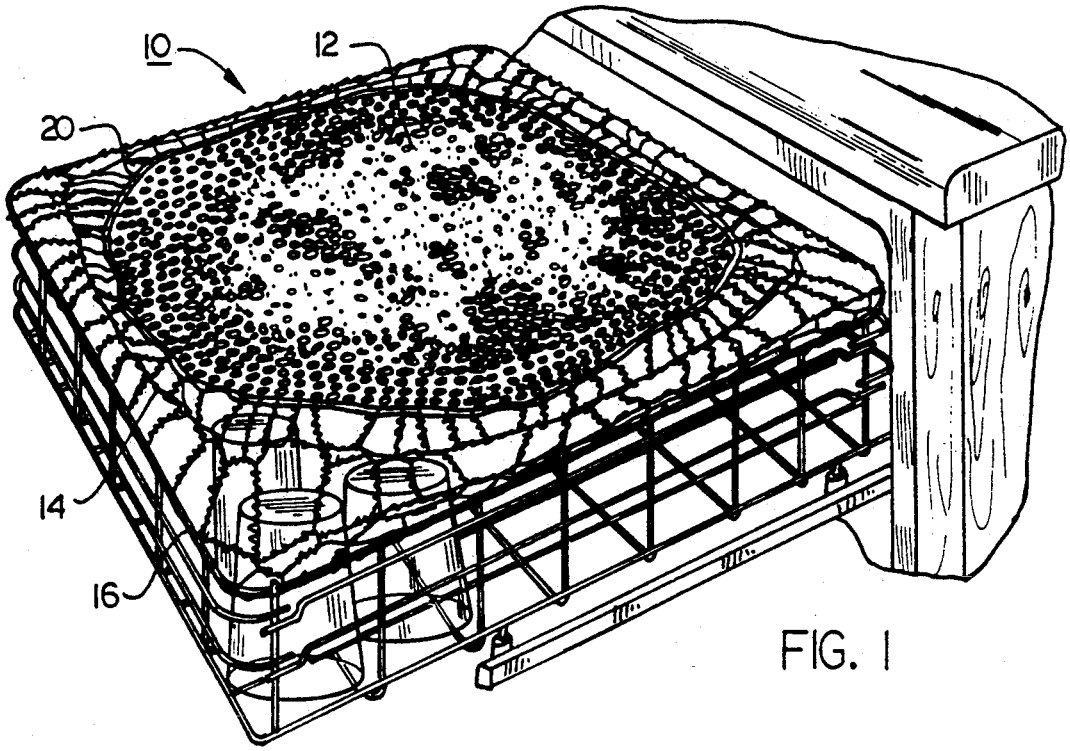
FIG. 1
FIG. 2
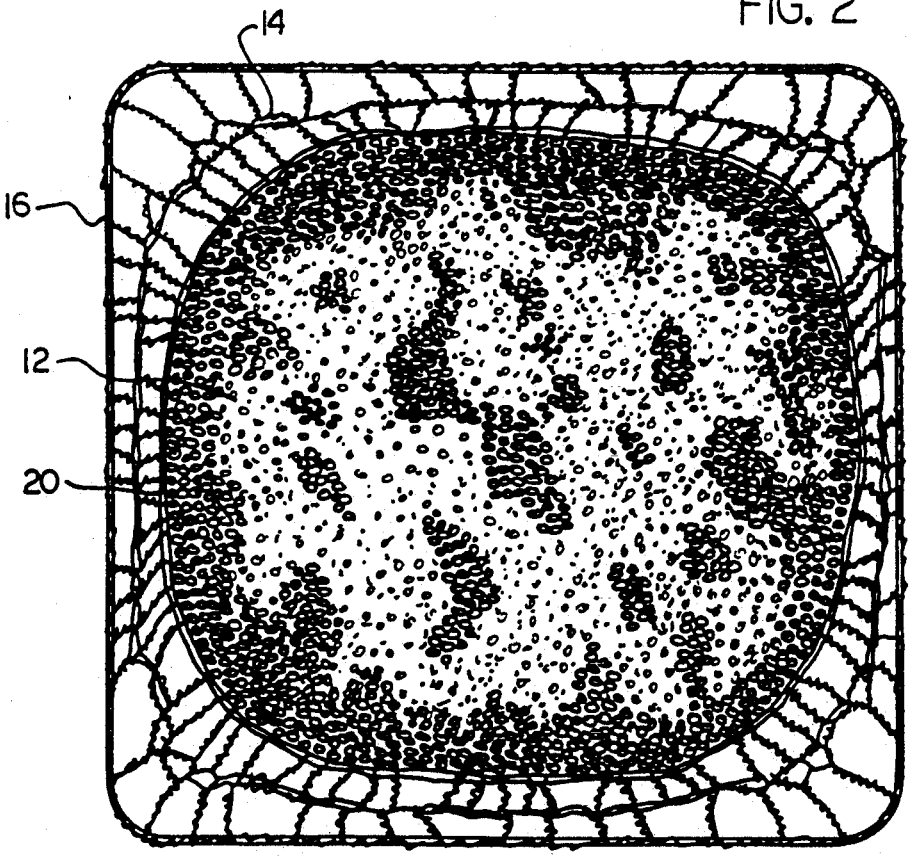

FIG. 3
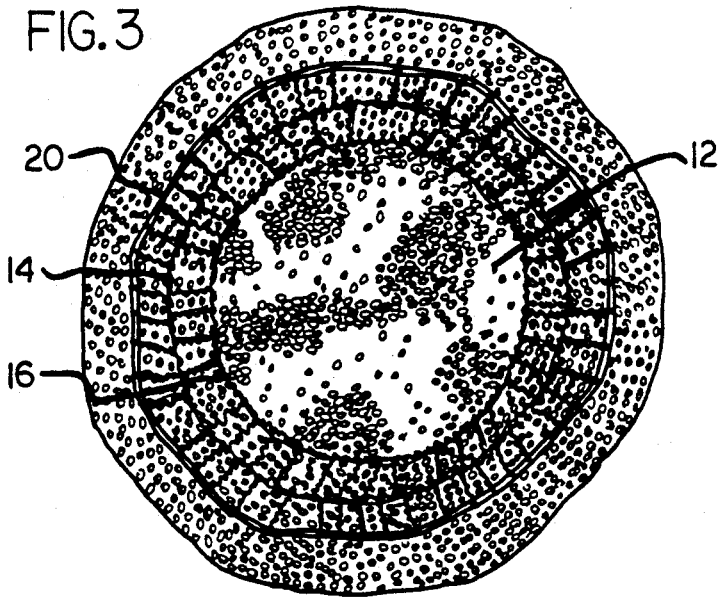
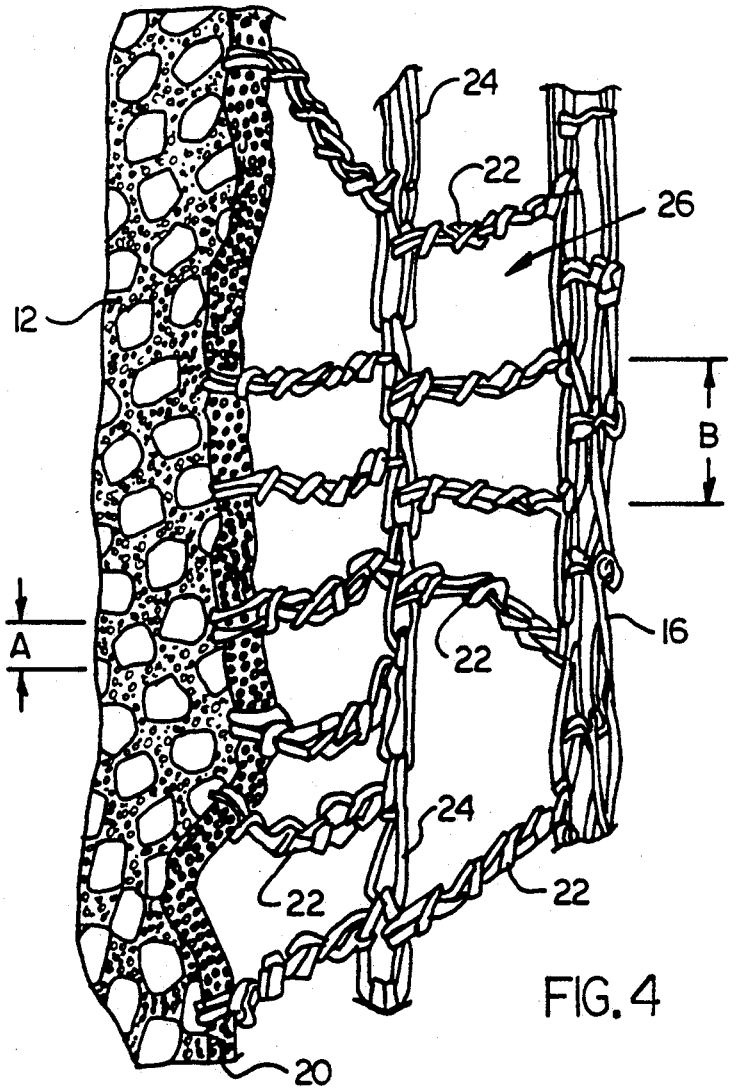
FIG. 4

NET FOR DISHWASHER RACK

BACKGROUND OF THE INVENTION (1) Field of the Invention

The present invention relates generally to nets and, more particularly, to a removable elastic net for supporting and preventing movement of dishware in the racks of a dishwasher.

(2) Description of the Prior Art

Most modern dishwashers have a pair of upper and lower racks which are slidable mounted to tracks fixed to the inner sides of the dishwasher. Such racks are pulled out for easy loading and unloading of the dishware. Cups, glasses and other dishware are normally placed upside down along the racks for washing. During operation of the dishwasher, high pressure streams of water are directed against the items of dishware in the racks. The problem with this type of dishwasher is that the pressure of the water stream may be strong enough to cause the dishware to right side up during washing and fill with water. As a result, not only does the dishware itself fail to be properly cleaned but during unloading the upright dishware sometimes tips over and spills dirty water on the already clean dishes below. In addition, expensive long stemmed glasses have a tendency to tip over and knock into one another causing breakage. Consequently, many households equipped with such dishwashers wash the above types of dishware by hand.

Some attempts have been made in the past to solve the general problem of securing and supporting dishware in the racks of a dishwasher against movement during cleaning. U.S. Pat. No. 3,901,728, issued to Opal, discloses a flat or arcuate disk of plastic, nylon or rubber-like material designed to fit over the central hub of an upper rotatable, slidably mounted rack of an automatic dishwasher in which have been placed items of lightweight plastic or glass dishware. Although useful for dishwashers having a top rack rotatable on a central hub, such a design is not adaptable for use with more conventional "hubless" dishwasher racks. However, the Opal patent does provide a good background discussion of other techniques which have been used for supporting dishware during washing.

Specific examples of the use of a retaining net for supporting dishware during washing are not known. However, U.S. Pat. No. 4,664,266, issued to Fausett et al., does disclose a storage hammock usable for a variety of purposes. However, the netting and binding of the storage hammock taught by Fausett et al. is substantially inelastic and would not provide sufficient stretch to allow its use in a dishwasher.

Thus there remains a need for a new and improved removable net for supporting and preventing movement of dishware during washing in the racks of a dishwasher which is sufficiently elastic to conform to the shape of the dishware and the racks and, at the same time, is insensitive to hot water and detergents and permits the normal operation of the dishwasher.

SUMMARY OF THE INVENTION

The present invention is directed to a removable retaining net for a dishwasher rack. The net includes a circular shaped center portion formed of substantially inelastic water resistant mesh; a bidirectionally elastic, open loop annular band connected along the periphery of the center portion; and an elastic edge band connected along the periphery of the annular band. The edge of the annular band adjacent to the center portion is substantially equal to the length of the periphery of the center portion and the edge of the annular band opposite the edge of the annular band adjacent to the center portion is substantially less than the length of the periphery of the center portion. This construction provides tension along the periphery of the net when in use. Preferably the annular band is crocheted from 340 denier elastic yarn. Also, in the preferred embodiment the center portion is about 19 inches in diameter after hemming and is formed from water resistant polyester fabric having a mesh size of about ¼ inches in diameter. The periphery of the center portion can be hemmed to provide increased strength.

Accordingly, one aspect of the present invention is to provide a retaining net for a dishwasher rack. The net includes: (a) a center portion formed of substantially inelastic mesh and (b) an elastic annular band connected along the periphery of the center portion, wherein the edge of the band adjacent to the center portion is substantially equal to the length of the periphery of the center portion and the edge of the band opposite the edge of the band adjacent to the center portion is substantially less than the length of the periphery of the center portion.

Another aspect of the present invention is to provide a retaining net for a dishwasher rack. The net includes: (a) a circular shaped center portion formed of substantially inelastic mesh; and (b) a bidirectionally elastic, open loop annular band connected along the periphery of the center portion, wherein the edge of the band adjacent to the center portion is substantially equal to the length of the periphery of the center portion and the edge of the band opposite the edge of the band adjacent to the center portion is substantially less than the length of the periphery of the center portion.

Still another aspect of the present invention is to provide a retaining net for a dishwasher rack. The net includes: (a) a circular shaped center portion formed of substantially inelastic water resistant mesh; (b) a bidirectionally elastic, open loop annular band connected along the periphery of the center portion, wherein the edge of the band adjacent to the center portion is substantially equal to the length of the periphery of the center portion and the edge of the band opposite the edge of the band adjacent to the center portion is substantially less than the length of the periphery of the center portion; and (c) an elastic edge band connected along the periphery of the annular band.

These and other aspects of the present invention will become apparent to those skilled in the art after a reading of the following description of the preferred embodiment when considered with the drawings.

BRIEF DESCRIPTION OF THE DRAWINGS

FIG. 1 is perspective view of a retaining net for the rack of a dishwasher constructed according to the present invention;

FIG. 2 is a top plan view of the net stretched out across the top of the rack;

FIG. 3 is a bottom plan view of the net shown in its flaccid condition; an

FIG. 4 is a enlarged partial fragmentary view of the edge treatment of the net shown in FIG. 3.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a retaining net for the rack of a dishwasher, generally designated 10, is shown constructed according to the present invention. The net 10 includes a center portion 12, an annular band 14 and an elastic reinforcing edging 16. Center portion 12 is a generally circular shaped, substantially inelastic mesh material preferably formed from durable, water-resistant materials such as polyester, nylon or rayon or similar synthetic materials. Annular band 14 is an open looped, bidirectionally elastic band having an outer diameter substantially less than its inner diameter. Preferably, annular band 14 and the elastic reinforcing edging 16 are crocheted from a high denier elastic yarn.

As best seen in FIG. 2, when in use, the annular band 14 and reinforcing edging band 16 are sufficiently elastic to conform to the rectangular shape of the racks of the dishwasher. In addition, because of the symmetry of circular shape of the center portion 12, it is not necessary to orient the net 10 prior to attaching it to the racks of the dishwasher. This construction allows the net to be quickly put into use with a minimum of attention.

As can be seen in FIG. 3, the bidirectionally elastic, open looped annular band 14 is connected along the periphery of the center portion 12. In addition, the edge of the annular band 14 adjacent to the center portion 12 is substantially equal to the length of the periphery of the center portion. On the other hand, the edge of the annular band 14 opposite the edge of the annular band adjacent to the center portion 12 is substantially less than the length of the periphery of the center portion. This creates a hairnet-type construction in which the edge of the annular band 14 adjacent to the elastic reinforcing band 16 and the elastic reinforcing band 16 itself are always under tension when in use.

Finally, turning to FIG. 4, there is shown an enlarged fragmentary view of the edge treatment of the net shown in FIG. 3. Preferably the edge of center portion 12 attached to annular band 14 is formed into a reinforcing hem 20 to reduce the change of tearing during use.

Preferably, annular band 14 consists of a plurality of outwardly extending strands 22 interconnected by perimeter strands 24. Both the outwardly extending strands 22 and perimeter strands 24 are preferably constructed of a high denier elastic yarn. This type of construction creates a large number of open loops 26 which are sufficiently large to permit the flow of water through while, at the same time, permitting annular band 14 to stretch in all directions.

Preferably, the circular shaped center portion 12 has a plurality of openings of approximately ¼" as shown by the dimension "A". This diameter is sufficiently large to allow particles of food and water to pass through without allowing portions of the dishware to extend through and get tangled therein. Similarly, annular band 14 has openings of about 1 inch square as shown by dimension "B".

One suitable material for the center portion 12 is polyester mesh fabric of 150 denier, 50 filament construction. One source of a fabric which is particularly suitable for use in the present invention is available from Fuller Specialties Co. of Burlington, N.C.

The high denier elastic yarn is preferably 340 denier yarn. One yarn which is particularly suitable is sold as 34GM 800 rubber with 20 line 3 spun poly inner and 20 spun poly outer. This yarn is available from MacField, Inc. of Madison, N.C.

In constructing the net 10, a flat circular section of the mesh material is first cut. In the preferred embodiment, a 19 inch diameter section, after hemming the perimeter, has been found to be suitable for most conventional upper dishwasher racks. The annular band portion 14 is then crocheted about the perimeter of the center portion 12 using a quadruple crochet—five in a row, then skipping about an inch and repeating. Finally, the reinforcing edging band 16 is added. This also preferably is crocheted using a single crochet stitch in every loop.

In use, net 10 is grasped with both hands along the inner edges of annular band 14 and elastic reinforcing band 16 and preferably attached first to the rear prongs of the racks of the dishwasher. The user's hands are then slid forward along the inner edge of the annular band 14 and elastic reinforcing band 16 and the net is pulled forward until it attaches to the front of the dishwasher rack. As previously shown in FIG. 2, the bidirectional elasticity of the annular band permits net 10 to conform to the shape of the dishwasher racks. In addition, circular shaped center portion 12 does not require any special orientation of the net 10.

Certain modifications and improvements will occur to those skilled in the art upon reading of the foregoing description. By way of example, the annular band portion 14 about the perimeter of the center portion 12 could be formed from a one piece molded rubber or similar material. It should be understood that all such modifications and improvements have been deleted herein for the sake of conciseness and readability but are properly within the scope of the following claims.

I claim:

1. A retaining net for a dishwasher rack, said net comprising:

(a) a center portion formed of substantially inelastic mesh; and (b) an elastic annular band connected along the periphery of said center portion, wherein the edge of said band adjacent to said center portion is substantially equal to the length of the periphery of said center portion and the edge of said band opposite the edge of said band adjacent to said center portion is substantially less than the length of the periphery of said center portion.

2. The net according to claim 1, further including an elastic edge band connected along the periphery of said annular band for reinforcing said annular band.

3. The net according to claim 1, wherein said annular band is formed of an open loop construction to provide bidirectional elasticity.

4. The net according to claim 3, wherein said annular band is crocheted from elastic yarn.

5. The net according to claim 4, wherein said annular band is formed of 340 denier elastic yarn.

6. A retaining net for a dishwasher rack, said net comprising:

(a) a circular shaped center portion formed of substantially inelastic mesh; and (b) a bidirectionally elastic, open loop annular band connected along the periphery of said center portion, wherein the edge of said band adjacent to said center portion is substantially equal to the length of the periphery of said center portion and the edge of said band opposite the edge of said band adjacent to said center portion is substantially less than the length of the periphery of said center portion.

7. The net according to claim 6, wherein said center portion is about 19 inches in diameter.

8. The net according to claim 6, wherein said the mesh size of said center portion is about ¼ inches in diameter.

9. The net according to claim 6, wherein said center portion is formed from a water resistant material.

10. The net according to claim 9, wherein said water resistant material is polyester.

11. The net according to claim 6, wherein the periphery of said center portion is hemmed to provide increased strength.

12. A retaining net for a dishwasher rack, said net comprising:

(a) a circular shaped center portion formed of substantially inelastic water resistant mesh;

(b) a bidirectionally elastic, open loop annular band connected along the periphery of said center portion, wherein the edge of said band adjacent to said center portion is substantially equal to the length of the periphery of said center portion and the edge of said band opposite the edge of said band adjacent to said center portion is substantially less than the length of the periphery of said center portion; and (c) an elastic edge band connected along the periphery of said annular band.

13. The net according to claim 12, wherein said annular band is crocheted from elastic yarn.

14. The net according to claim 13, wherein said annular band is formed of 340 denier elastic yarn.

15. The net according to claim 12, wherein said center portion is about 19 inches in diameter.

16. The net according to claim 12, wherein said the mesh size of said center portion is about ¼ inches in diameter.

17. The net according to claim 12, wherein said center portion is formed from a water resistant material.

18. The net according to claim 17, wherein said water resistant material is polyester.

19. The net according to claim 12, wherein the periphery of said center portion is hemmed to provide increased strength.

* * * * *